United States Patent [19]

Johnson

[11] Patent Number: 5,018,711

[45] Date of Patent: May 28, 1991

[54] CLAMP FOR INSTALLING DRAWER FRONTS

[76] Inventor: Douglas L. Johnson, 1523 Gannon Dr., Sacramento, Calif. 95825

[21] Appl. No.: 465,406

[22] Filed: Jan. 16, 1990

[51] Int. Cl.[5] ..... B25B 1/10

[52] U.S. Cl. ..... 269/43; 269/249

[58] Field of Search ..... 269/37, 41, 43, 246, 269/249

[56] References Cited

U.S. PATENT DOCUMENTS

| | | | |
|---|---|---|---|
| 2,228,593 | 1/1941 | Dibble et al. | 269/43 |
| 2,568,233 | 9/1951 | Hamilton | 269/43 |
| 2,606,583 | 8/1952 | O'Connor | 144/297 |
| 2,627,113 | 2/1953 | Moray | 32/63 |
| 3,934,316 | 1/1976 | Driscoll | 24/243 CC |
| 3,952,936 | 4/1976 | Dearman | 269/43 |
| 4,093,202 | 6/1978 | Kincaid | 269/321 S |
| 4,234,176 | 11/1980 | Goff et al. | 269/156 |
| 4,237,614 | 12/1980 | Williams | 269/43 |

*Primary Examiner*—J. J. Hartman
*Attorney, Agent, or Firm*—Jerry T. Kearns

[57] ABSTRACT

A clamp for use in aligning and installing cosmetic fronts on drawers includes first and second clamp body members which have respective connecting flanges adjustably secured by threaded fasteners. Juxtaposed threaded clamping jaws allow a cosmetic front to be clamped on a drawer face. The clamp is formed from thin sheet metal material and has an offset construction which allows the drawer to be closed with the clamp installed. The thickness of the sheet metal stock material is utilized to determine the spacing between a top edge of the cosmetic drawer front and the cabinet in which it is mounted. The adjustable connecting flanges allow the clamp to clear a "sub-top" which is present in some cabinets, thus allowing the spacing between a top edge of the cabinet top or adjacent drawer front to be precisely regulated.

7 Claims, 4 Drawing Sheets

CLAMP FOR INSTALLING DRAWER FRONTS

BACKGROUND OF THE INVENTION

1. Field of the Invention

The present invention relates to clamps, and more particularly pertains to a clamp for installing cosmetic drawer fronts on the face of a slidable drawer mounted within a cabinet or other enclosing structure. Because of the close fit between the cabinet and the drawer, conventional C-clamps cannot be utilized to secure the cosmetic front on the drawer face and still allow closure of the drawer. Conventionally, a cabinet maker must hold the cosmetic drawer front by hand or other means during alignment until the drawer is opened sufficiently to install a conventional clamp. This results in frequent misalignment of the cosmetic drawer front on the drawer face and the expenditure of a large amount of time in achieving proper alignment. In order to overcome this problem, the present invention provides a specially constructed clamp which remains installed while the drawer is closed.

2. Description of the Prior Art

Various types of clamps are known in the prior art. A typical example of such a clamp is to be found in U.S. Pat. No. 2,606,583, which issued to J. O'Connor on Aug. 12, 1952. This patent discloses a clamping fixture having threadably adjustable clamping jaws disposed at right angles. U.S. Pat. No. 2,627,113, which issued to J. Moray on Feb. 3, 1953, discloses a dental inlay clamp having a fixed clamping jaw coaxially disposed with a first threaded clamping jaw and a second transverse threaded clamping jaw. The second clamping jaw is mounted for lateral adjustment along the clamp body. U.S. Pat. No. 3,934,316, which issued to D. Driscoll on Jan. 27, 1976, discloses a C-clamp having aligned threaded clamping jaws. The clamp body is formed by adjustably interconnected sections. U.S. Pat. No. 4,093,202, which issued to J. Kincaid on June 6, 1978, discloses a cabinet door mounting clamp for holding cabinet doors while they are being mounted by hinges. The clamp includes a pair of threaded clamping jaws disposed at right angles and an offset sheet metal clamp body for insertion between a closed cabinet door and a cabinet frame. U.S. Pat. No. 4,234,176, which issued to O. Goff et al on Nov. 18, 1980, discloses a quick release clamp having a generally C-shaped clamp body and including a first pair of aligned threaded clamping jaws and a single perpendicular threaded alignment abutment staff.

While the above mentioned devices are directed to various forms of adjustable clamps, none of these devices allow a cosmetic drawer front to be installed and aligned while allowing closure of the drawer in a cabinet. Additionally, none of the prior art clamps allow precise regulation of the position of a cosmetic drawer front with a cabinet top or adjacent drawer face. Inasmuch as the art is relatively crowded with respect to these various types of clamps, it can be appreciated that there is a continuing need for and interest in improvements to such clamps, and in this respect, the present invention addresses this need and interest.

SUMMARY OF THE INVENTION

In view of the foregoing disadvantages inherent in the known types of clamps now present in the prior art, the present invention provides an improved clamp for installing drawer fronts. As such, the general purpose of the present invention, which will be described subsequently in greater detail, is to provide a new and improved clamp for installing drawer fronts which has all the advantages of the prior art clamps and none of the disadvantages.

To attain this, representative embodiments of the concepts of the present invention are illustrated in the drawings and make use of a clamp for use in aligning and installing cosmetic fronts on drawers which includes first and second clamp body members which have respective connecting flanges adjustably secured by threaded fasteners. Juxtaposed threaded clamping jaws allow a cosmetic front to be clamped on a drawer face. The clamp is formed from thin sheet metal material and has an offset construction which allows the drawer to be closed with the clamp installed. The thickness of the sheet metal stock material is utilized to determine the spacing between a top edge of the cosmetic drawer front and the cabinet in which it is mounted. The adjustable connecting flanges allow the clamp to clear a "sub-top" which is present in some cabinets, thus allowing the spacing between a top edge of the cabinet top or adjacent drawer front to be precisely regulated.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved clamp for installing drawer fronts which has all the advantages of the prior art clamps and none of the disadvantages.

It is another object of the present invention to provide a new and improved clamp for installing drawer fronts which may be easily and efficiently manufactured and marketed.

It is a further object of the present invention to provide a new and improved clamp for installing drawer fronts which is of a durable and reliable construction.

An even further object of the present invention is to provide a new and improved clamp for installing drawer fronts which is susceptible of a low cost of manufacture with regard to both materials and labor, and which accordingly is then susceptible of low prices of sale to the consuming public, thereby making such clamps economically available to the buying public.

Still yet another object of the present invention is to provide a new and improved clamp for installing drawer fronts which provides in the apparatuses and methods of the prior art some of the advantages thereof, while simultaneously overcoming some of the disadvantages normally associated therewith.

Still another object of the present invention is to provide a new and improved clamp for installing drawer fronts which allows closure of a drawer within a cabinet for alignment purposes, while the clamp is installed.

Yet another object of the present invention is to provide a new and improved clamp for installing drawer fronts which facilitates precise alignment of a cosmetic drawer front on a drawer face with a cabinet top or adjacent drawer front.

Even still another object of the present invention is to provide a new and improved clamp for installing drawer fronts which is adjustable for use with drawers and cosmetic drawer fronts of various different dimensions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
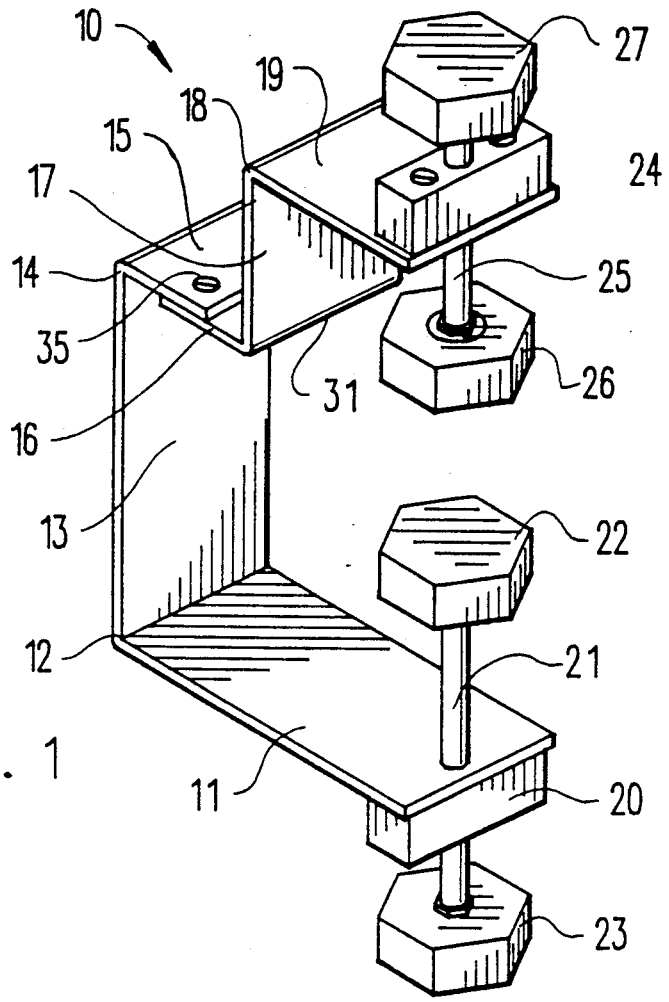
FIG. 1 is a perspective view of the clamp according to the present invention.

With reference now to the drawings, and in particular to FIG. 1 thereof, a new and improved clamp for installing drawer fronts embodying the principles and concepts of the present invention and generally designated by the reference numeral 10 will be described.

More specifically, it will be noted that the first embodiment 10 of the invention includes a first clamp body member having first 11 and second 13 perpendicular leg portions. The clamp body is preferably formed from a ⅛ inch thick sheet metal stock material which is deformed in a conventional bending press to form the various right angular corners. For example, the corner 12 formed by the intersection of the first 11 and second 13 leg portions is preferably ninety degrees. A first connecting flange 15 is perpendicularly formed by a right angular corner 14 on an end of the second leg portion 13. The first connecting flange 15 extends in spaced parallel relation with the first leg portion 11. A second clamp body member has third 19 and fourth 17 perpendicular leg portions formed by a right angular corner 18. A second connecting flange 16 is perpendicularly formed by a right angular corner 31 on an end of the fourth leg portion 17. The second connecting flange 16 partially overlies the first connecting flange 15, in abutting parallel relation therewith. Threaded fasteners such as the illustrated screw 35 are provided for adjustably securing the flanges 15 and 16. The first 11 and third 19 leg portions extend in spaced parallel relation. A first clamping jaw 22 is mounted for transverse threaded adjustment on the first leg portion 11. A second clamping 26 is mounted for transverse threaded adjustment on the third leg portion 19. The clamping jaws 22 and 26 are disposed between the first 11 and third 19 leg portions. The clamping jaw 22 is secured at one end of an elongated threaded shaft 21, which extends through the first leg portion 11 and a mounting block 20 secured thereto. A knob portion 23 is provided on an opposite end of the threaded shaft 21 for effecting adjustment thereof. Similarly, the clamping jaw 26 is formed at one end of the elongated threaded shaft 25 which extends through the third leg portion 19 and a mounting block 24 secured thereto. A knob member 27 is secured at an opposite end of the shaft 25 to effect manual threaded adjustment of the jaw 26.

Figure 2:
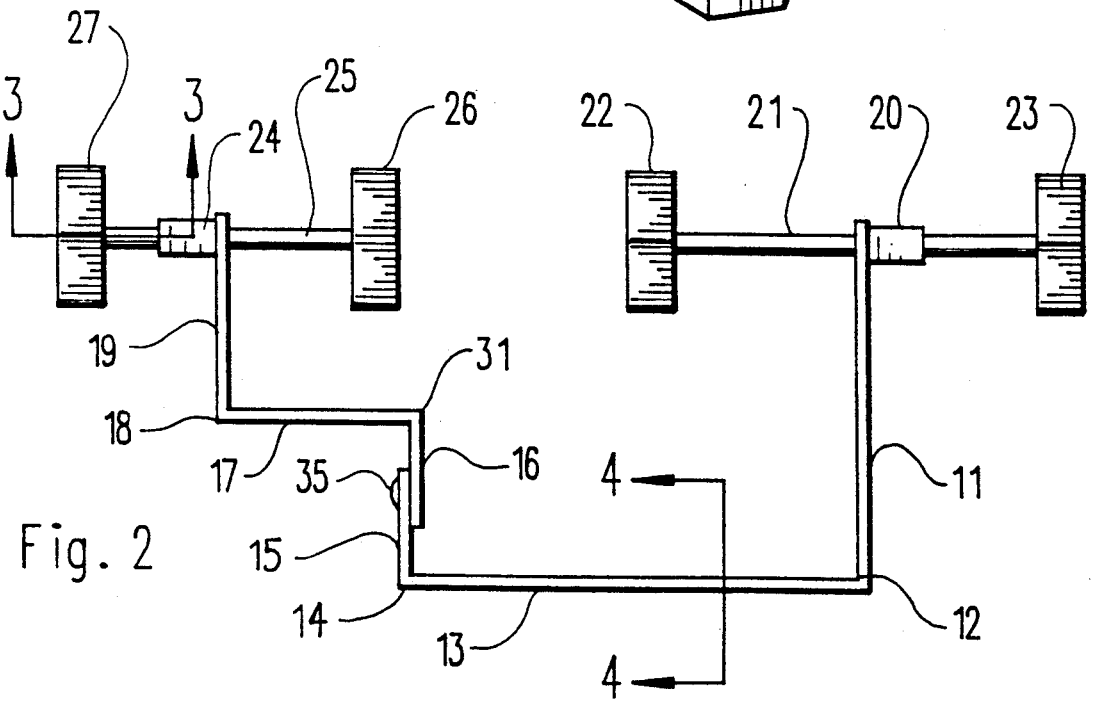
FIG. 2 is a side elevational view of the clamp of the present invention.

As shown in FIG. 2, the connecting flanges 15 and 16 are partially overlapped and secured by a threaded fastener such as a screw 35. The degree of overlap of connecting flanges 15 and 16 may be adjusted, in a manner to be described subsequently.

Figure 3:
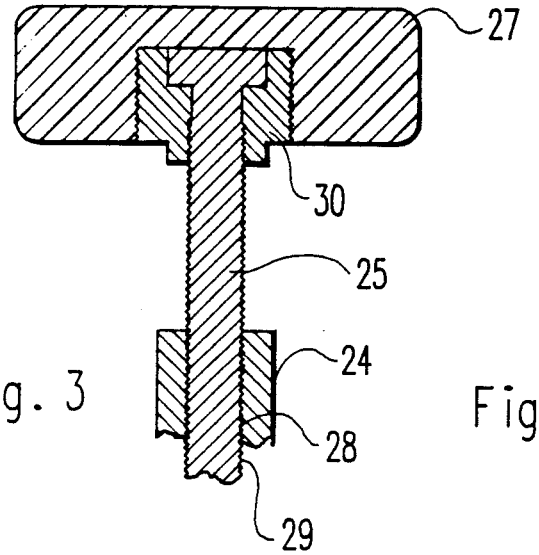
FIG. 3 is a cross sectional detail view, taken along line 3—3 of FIG. 2.

FIG. 3 is a detail view which illustrates an example form of construction for securing the adjusting knob 27 on the shaft 25. A threaded plug 30 has a hexagonal recess adapted to engage the hexagonal head of the shaft 25, which is preferably formed by a suitably hardened steel bolt. The knob portion 27 may be formed from nylon or other plastic material. The connection of the clamping jaws 22 and 26 may be similarly effected. The mounting block 24 has a threaded bore 28 which is engaged with the threads 29 formed along the length of the shaft 25. Thus, rotation of the knob 27 effects a threaded adjustment of the shaft 25 with respect to the block 24.

Figure 4:
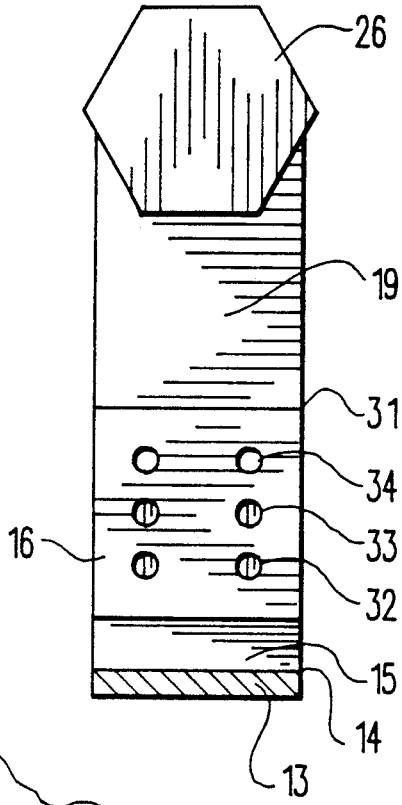
FIG. 4 is a cross sectional detail view, taken along line 4—4 of FIG. 2.

FIG. 4 illustrates a first alternative construction for adjustably securing the connecting flanges 15 and 16. The flange 16 is provided with a plurality of aligned pairs of threaded apertures 32, 33 and 34. These pairs of threaded apertures are evenly spaced along the length of the flange 16. The overlying flange 15 is provided with a similarly spaced, single pair of apertures for selective alignment with one of the pairs of apertures 32, 33 and 34. Thus, suitable machine screws may be installed through selected aligned pairs of apertures to effect relative longitudinal adjustment of the connecting flanges 15 and 16, in discreet increments.

Figure 5:
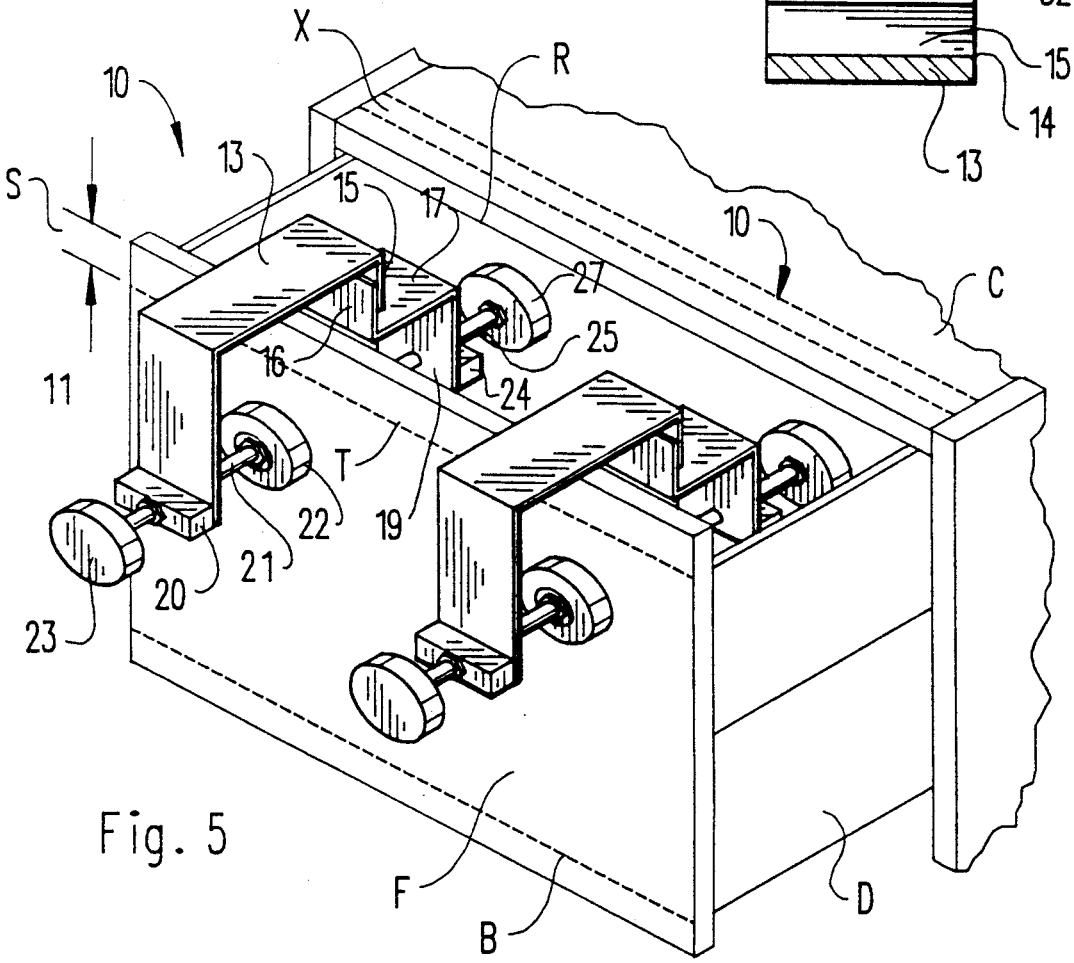
FIG. 5 is a perspective view illustrating the manner of use of a pair of clamps according to the present invention.

FIG. 5 is a perspective view which illustrates the manner of use of a pair of clamps 10 according to the present invention. A conventional cabinet C, within which there is a "sub-top" X, has a slidable drawer D upon which an ornamental front F is to be secured. The drawer D is conventionally formed as a open top rectangular box having a rough, unornamented front face. The top edge of the front face of the drawer D is indicated by the dotted line T. The bottom edge of the front face of the drawer D is indicated by the dotted line B. To secure the ornamental front F on the unornamented face of the drawer D, a pair of clamps 10 are installed by tightening the knob portions 23 and 27. The drawer may then be closed, because of the relatively small thickness of the clamp leg portion 13. Subsequent to closure of the drawer D into the cabinet C, the clamp knobs 23 are loosened, and the ornamental face F is precisely aligned with respect to the drawer D and the cabinet C. The clamp knobs 23 are then tightened, and the drawer is opened. The ornamental face F may then be secured in a conventional manner to the drawer D.

Figure 6:
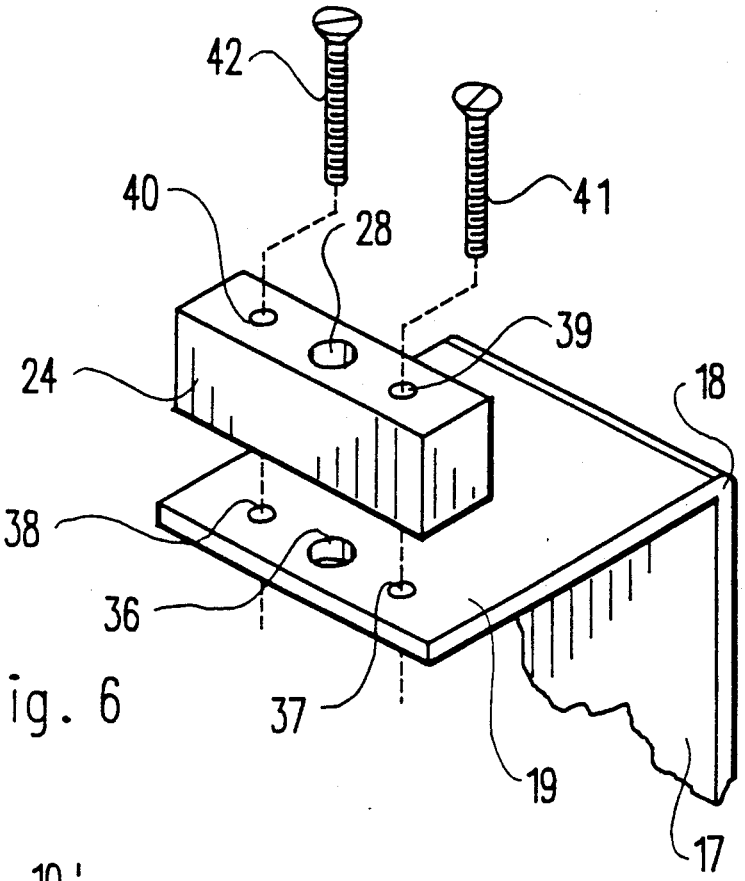
FIG. 6 is a partial perspective detail view illustrating the threaded adjustable jaw mounting assembly.

FIG. 6 is a perspective detail view which illustrates the mounting of the threaded block 24 on the clamp leg portion 19. A pair of apertures 39 and 40 are disposed for coaxial alignment with a second pair of threaded apertures 37 and 38 formed in the clamp leg 19. Conventional machine screws 41 and 42 are then utilized to secure the block 24 permanently to the clamp leg 19. Alternatively, the block 24 may be integrally formed with the leg 19, or secured by welding. A larger diameter threaded aperture 28 is formed through the block 24 in coaxial alignment with the threaded aperture 36 formed through the clamp leg 19. It should be understood that the block 20 is similarly secured.

Figure 7:
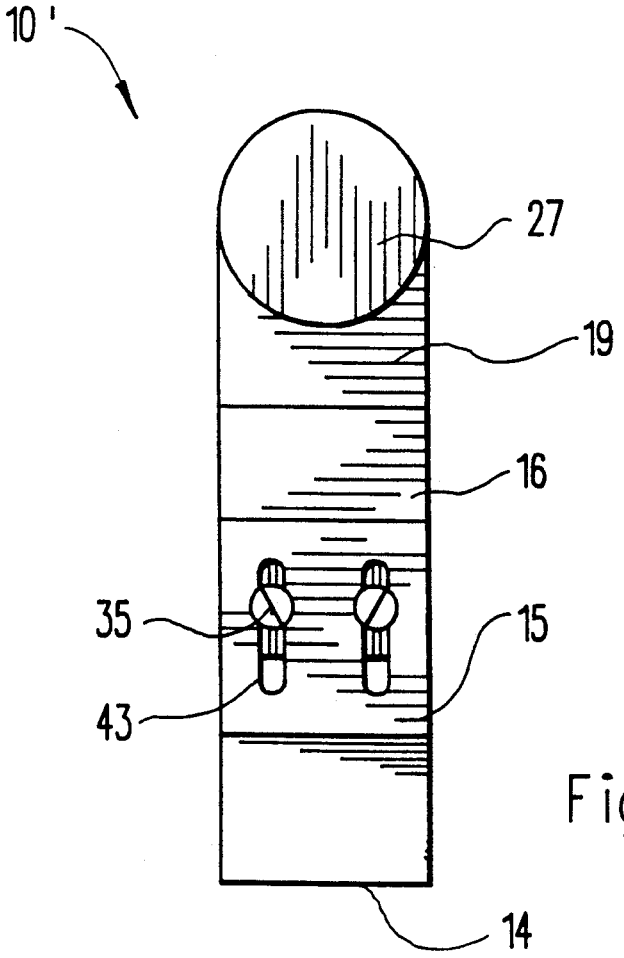
FIG. 7 is an end view illustrating a slightly modified alternative construction of the clamp of the present invention.

FIG. 7 illustrates an alternative clamp construction 10', in which the connecting flanges 15 and 16 are mounted for adjustment by a slot 43 formed through the flange 15 and a threaded aperture formed in the flange 16. A threaded fastener, such as a machine screw 35, is then inserted through the slot 43 and into engagement with the threaded aperture formed in the flange 16. By tightening the screw 35, the enlarged head of the screw 35 will clamp the flange 15 against the flange 16. As shown, a pair of aligned elongated slots and cooperating threaded fasteners are preferably utilized to provide an increased strength connection. It should be noted that this alternative construction allows infinite adjustment of the flanges 15 and 16, within the range determined by the length of the slots 43. It should be understood that this represents an alternative to the discreet adjustment afforded by the arrangement illustrated in FIG. 4.

Figure 8:
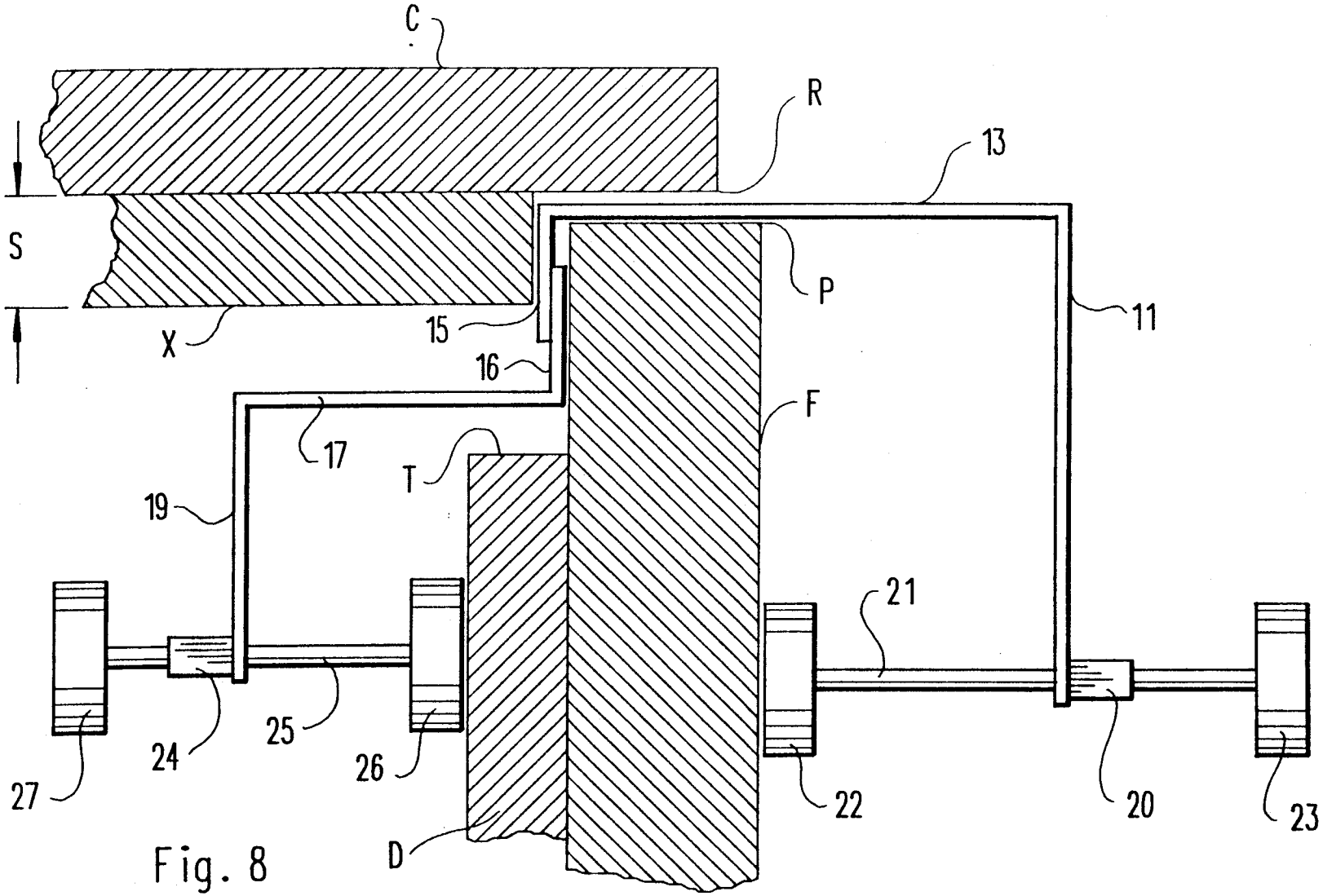
FIG. 8 is a diagrammatic cross sectional view further illustrating the manner of use of the clamp according to the present invention.

FIG. 8 is a diagrammatic view which further illustrates the manner of use of the clamp 10 according to the present invention. The original rough face of the drawer D has a top edge T. The top edge of the leg 17 is disposed in alignment with the edge X, corresponding to the spacing S. The extent of overlap of the connecting flanges 15 and 16 is then adjusted utilizing the threaded fasteners 35 (FIG. 7), until the desired spacing S between the top edge of leg 17 and the edge X has been effected. Abutment of the bottom surface of the clamp leg 13 with the edge P serves as an alignment guide to allow a user to regulate the desired spacing between the edges P and R. The clamp knobs 27 and 23 are then tightened, to force the clamping jaws 22 and 26 into respective engagement with the ornamental face F and the interior surface of the rough drawer face D. The knob 23 is then adjusted to force the clamping jaw 22 into engagement with the exterior surface of the ornamental face F. As previously mentioned, the clamping jaws 22 and 26 are preferably formed from nylon or other plastic material to prevent marring of the cabinet surfaces. The thickness of the clamp leg portion 13 is utilized to determine the spacing between the bottom edge R of the cabinet C and the top edge P of the ornamental face F. As may now be appreciated, the connecting flanges 15 and 16 may be adjusted, depending upon the dimensions of the drawer D, the ornamental face F, and the desired spacing S, which allows proper clearance of "sub-top" X of cabinet C. As shown, the clamp 10 has an offset construction, which, in conjunction with the relatively thin sheet metal material of the clamp body, allows the clamp 10 to remain installed, with the drawer D in a substantially closed position. The knob 23 may then be loosened slightly, to release the jaw 22, while the face F is precisely aligned. As shown in FIG. 5, a pair of clamps 10 are preferably employed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A clamp for use in installing a drawer front on a front face of a drawer and maintaining alignment of the front face and drawer front when the drawer is in a closed condition within a cabinet, comprising:

a first clamp body member formed from a thin, flat material and having first (11) and second (13) perpendicular leg portions;

a thin, flat first connecting flange (15) perpendicularly formed on an end of said second leg portion (11), said first connecting flange (15) extending in spaced parallel relation with said first leg portion (11);

a second clamp body member formed from a thin, flat material and having third (19) and fourth (17) perpendicular leg portions;

a thin, flat, second connecting flange (16) perpendicularly formed on an end of said fourth leg portion (17), said second connecting flange (16) at least partially overlying said first connecting flange (15) in abutting parallel relation therewith;

said first (11) and third (19) leg portions extending in spaced parallel relation;

a first clamping jaw (22) mounted on a first threaded shaft (21) extending transversely through said first leg portion (11) for threaded adjustment in a direction perpendicular to said first leg portion (11);

a second clamping jaw (26) mounted on a second threaded shaft (25) extending transversely through said third leg portion (19) or threaded adjustment in a direction perpendicular to said third leg portion (19), said first (22) and second (26) clamping jaws disposed between said first (11) and third (19) leg portions; and fastening means (35) for adjustably securing said first (15) and second (16) connecting flanges to adjust offset of said first (22) and second (28) clamping jaws in a direction perpendicular to longitudinal axes of said first (21) and second (25) threaded shafts, and simultaneously adjust offset of said second (13) and fourth (17) leg portions.

2. The clamp for installing drawer fronts of claim 1, wherein said fastening means comprises at least one threaded member (35) extending through one of said first (15) or second (16) connecting flanges and a plurality of spaced cooperating threaded apertures (32, 33, 34) formed in the other of said first (15) or second (16) connecting flanges.

3. The clamp for installing drawer fronts of claim 1, wherein said fastening means comprises at least one elongated slot (43) formed in one of said first (15) or second (16) connecting flanges;

at least one threaded member (35) extending through said slot; and at least one cooperating threaded aperture formed in the other of said first (15) or second (16) connecting flanges.

4. The clamp for installing drawer fronts of claim 1, wherein said first and second clamp body members are formed from sheet metal.

5. The clamp for installing drawer fronts of claim 4, wherein said sheet metal is about $\frac{1}{8}$ inches thick.

6. The clamp for installing drawer fronts of claim 1, wherein said third leg portion (19) and second connecting flange (16) extend in opposite directions from opposite ends of said fourth leg portion (17).

7. The clamp for installing drawer fronts of claim 1, wherein said fastening means allows adjustment of spacing between a free end edge of said second connecting flange (16) and said second (13) leg portion for determining alignment of a drawer front on a drawer face.

* * * * *